US005227757A

United States Patent [19]

Hirota et al.

[11] Patent Number: 5,227,757

[45] Date of Patent: Jul. 13, 1993

[54] TERMINAL DEVICE

[75] Inventors: Takato Hirota; Shigeaki Ohtake; Kuniyuki Kogawa, all of Kanagawa, Japan

[73] Assignee: Fuji Electric Co., Ltd., Kanagawa, Japan

[21] Appl. No.: 509,774

[22] Filed: Apr. 17, 1990

[30] Foreign Application Priority Data

Apr. 24, 1989 [JP] Japan ..... 1-104065

[51] Int. Cl.[5] ..... H01F 15/10

[52] U.S. Cl. ..... 336/192; 439/723; 439/733

[58] Field of Search ..... 439/733, 723, 724, 74, 439/801, 888, 890, 869, 444; 336/192, 208; 310/71, 234

[56] References Cited

U.S. PATENT DOCUMENTS

| | | | |
|---|---|---|---|
| 1,823,827 | 9/1931 | Franz | 336/192 |
| 2,922,138 | 1/1960 | Comins, Jr. | 439/890 X |
| 2,953,758 | 9/1960 | Stanwyck | 336/192 |
| 3,445,797 | 5/1969 | Otto | 336/192 |
| 3,510,823 | 5/1970 | Cervenka et al. . | |
| 3,603,917 | 9/1971 | Owen | 336/192 |
| 4,347,493 | 8/1982 | Adams et al. | 336/208 |

FOREIGN PATENT DOCUMENTS

| | | | |
|---|---|---|---|
| 0217110 | 4/1987 | European Pat. Off. . | |
| 1213910 | 4/1966 | Fed. Rep. of Germany | 336/192 |
| 2320820 | 11/1974 | Fed. Rep. of Germany | 336/192 |
| 3039457 | 5/1982 | Fed. Rep. of Germany . | |
| 3500785 | 7/1986 | Fed. Rep. of Germany . | |
| 898998 | 6/1962 | United Kingdom | 336/192 |
| 1184185 | 3/1970 | United Kingdom | 336/192 |

OTHER PUBLICATIONS

Communication from European Patent Office dated Oct. 29, 1992.

*Primary Examiner*—Thomas J. Kozma

*Attorney, Agent, or Firm*—Finnegan, Henderson, Farabow, Garrett & Dunner

[57] ABSTRACT

A terminal device for connecting an end portion of an exciting coil to an external conductor, said exciting coil being formed on a bobbin and operating, for example, a contact of an electromagnetic contactor. The terminal device includes a terminal base mounted on the bobbin, an electrically conductive terminal plate, and means for mounting the terminal plate to the terminal base such that a force exerted on the terminal plate at its end connected to the external conductor is not transmitted to the end portion of the exciting coil.

5 Claims, 3 Drawing Sheets

TERMINAL DEVICE

BACKGROUND OF THE INVENTION

1. Field of the Invention

The present invention relates to a terminal device comprising a terminal base formed on a bobbin for an exciting coil for operating a contact of an electromagnetic contactor or the like, and a terminal plate fixedly connected to the terminal base.

2. Description of the Prior Art

A conventional terminal device of this type is shown in FIGS. 8 and 9. Terminal plate 22 is fixedly connected to terminal base 31 formed on bobbin 21. Terminal plate 22 comprises a rectangular electrically-conductive plate having one end portion bent perpendicularly to provide bent portion 17. Upwardly-directed projection 17*a* is formed on the end or edge of bent portion 17, and horizontally-projecting tongue 9, around which a wire of an exciting coil is wound, is formed on and protrudes outwardly from the end of bent portion 17. As shown in FIG. 9, terminal base 31 to which terminal plate 22 is fixedly connected has L-shaped groove 31*d* into which terminal plate 22 is inserted in a direction of the plane thereof. Terminal base 31 also has hole 31*a* which engages projection 17*a* when terminal plate 22 is inserted into L-shaped groove 31*d*. Terminal plate 22, when inserted into groove 31*d*, is retained by terminal base 31 so that terminal plate 22 is immovable upward and downward, right and left, and back and forth. Side wall 31*c* of terminal base 31 is abutted against a side of terminal plate 22 when terminal plate 22 is fully inserted into L-shaped groove 31*d* of terminal base 31, thereby positioning terminal plate 22. Side wall 31*c* also serves to effect an intimate engagement of projection 17*a* in hole 31*a*.

The problems with the terminal device of the above construction are as follows. Namely, as is well known, a wire having a very small diameter is used as an exciting coil winding of an electromagnetic contactor or the like, wherein the exciting coil winding is connected to terminal plate 22 by winding one end portion of the exciting coil winding around tongue 9. In addition, an external conductor is connected to terminal plate 22 by threading terminal screw 3 into screw hole 22*a* of terminal plate 22. During this threading operation, however, a large force is applied to terminal plate 22, and if the distance between bent portion 17 of terminal plate 22 and screw hole 22*a* is long, a large bending moment acts on the bent portion 17. As a result, tongue 9 on which the end portion of the exciting coil winding is wound moves thus causing a risk that the end portion of the exciting coil winding may be cut.

SUMMARY OF THE INVENTION

An object of this invention is to provide a terminal device comprising a terminal base and a terminal plate wherein even if an external force acts on the terminal plate when connecting an external conductor to the terminal plate, this external force is not transmitted to the exciting coil winding.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve these objects and in accordance with the purpose of the invention, as embodied and broadly described herein, a terminal device is provided comprising a terminal base formed on a bobbin for an exciting coil for operating a contact of an electromagnetic contactor or the like, and a terminal plate fixedly connected to the terminal base, wherein the terminal plate comprises a rectangular electrically-conductive plate which is notched at its central portion thus forming an elongated extension portion at a longitudinal side portion of the plate, and wherein one end portion of the conductive plate is bent to form a bent portion in such a manner that the elongated extension portion comprises one side of an L-shaped configuration, a projection is formed on the bent portion, the bent portion is extended in a direction of the plane thereof in parallel relation to an upper surface of the elongated extension portion to form a tongue, a slit is formed longitudinally in the other end portion of the conductive plate from the side of the elongated extension portion, and that portion not extending from the elongated extension portion is bent such that it is parallel to and extends in the same direction as the bent portion at the one end portion thereby forming a wide L-shaped portion wherein a projection is formed on the thus bent portion, and the terminal base to which the terminal plate is to be fixedly connected has grooves into which the two bent portions of the terminal plate having the respective projections are respectively forced, and the terminal base also has a groove into which a non-bent portion of the wide L-shaped portion is to be inserted in a direction of the plane of the non-bent portion.

With this construction of the terminal device, the bent portions at the opposite longitudinal end portions of the terminal plate are forced respectively into the grooves of the terminal base, and the non-bent portion of the wide L-shaped portion of the terminal plate is inserted into the groove formed in another part of the terminal base in the direction of the plane thereof. As a result, the terminal plate is firmly connected to the terminal base at its opposite end portions. The screw hole for connecting an external conductor to the terminal plate is disposed in the vicinity of the wide bent portion of the terminal plate and, therefore, a bending moment due to an external force created when threading the terminal screw into the terminal plate is received by this wide bent portion and is negligibly transmitted to the other bent portion. Moreover, the elongated extension portion is provided between the two bent portions, whereby even if an external force sufficiently large enough to deform the wide bent portion is applied, the elongated extension portion easily deforms as the wide bent portion deforms. Thus, the large force is still not transmitted to the other bent portion. Therefore, the movement of the tongue of the other bent portion on which the coil winding is wound is very small, thereby preventing the cutting of the coil winding. This provides an advantage in that the connection of the external conductor is readily accessible yet relatively safe from harm.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE PREFERRED EMBODIMENT

Reference will now be made in detail to a presently preferred embodiment of the invention, an example of which is illustrated in the accompanying drawings. Wherever possible, the same reference numbers will be used throughout the drawings to refer to the same or like parts.

Figure 1:
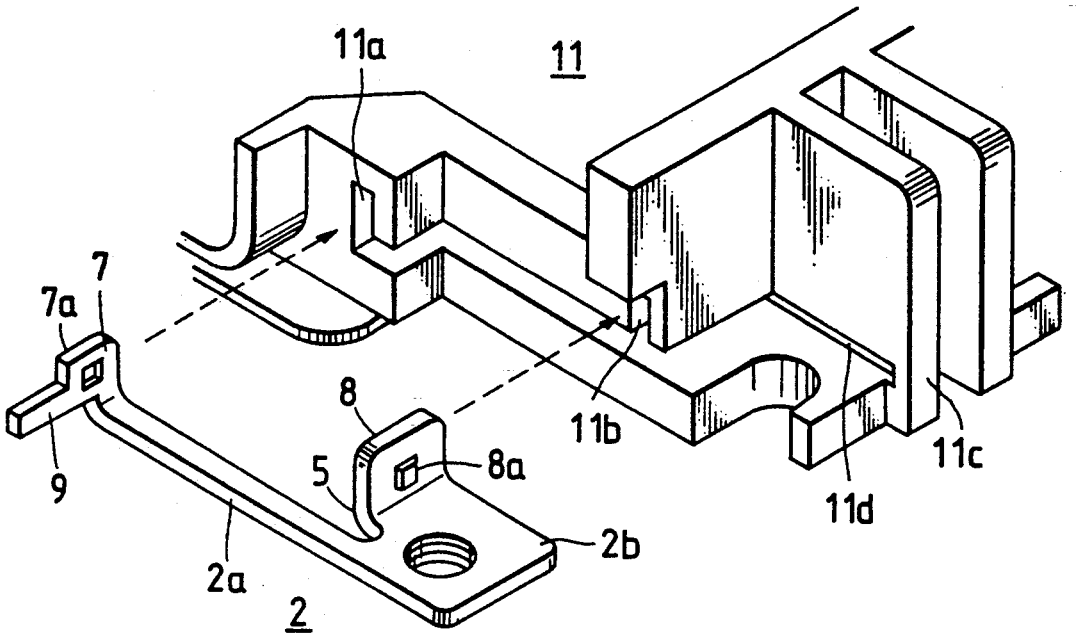
FIG. 1 is an exploded perspective view of a preferred embodiment of the present invention.
Figure 5:
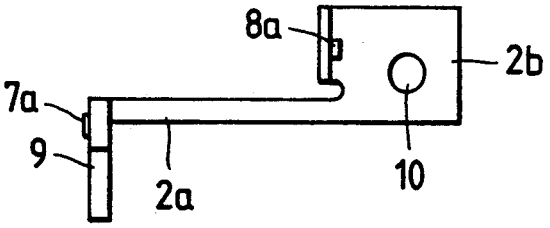
FIGS. 5, 6 and 7 are a plane view, a front-elevational view and a side-elevational view, respectively, of the terminal plate of FIG. 1.
Figure 6:
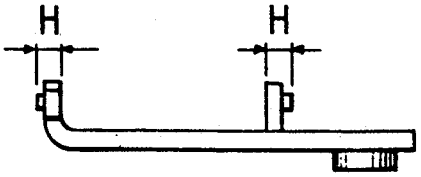
Figure 7:
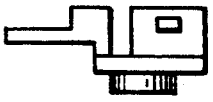
Figure 2:
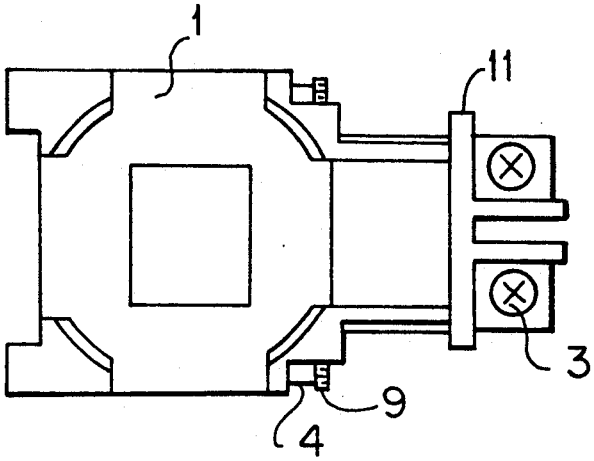
FIGS. 2 and 3 are a plane view and a front-elevational view, respectively, of a bobbin body incorporating the terminal device of FIG. 1.
Figure 3:
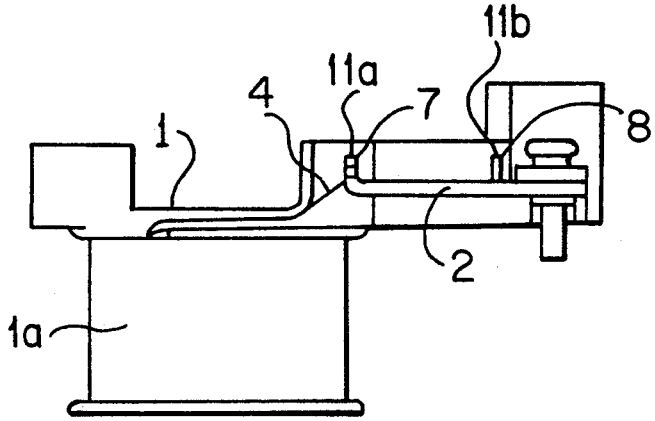
Figure 4:
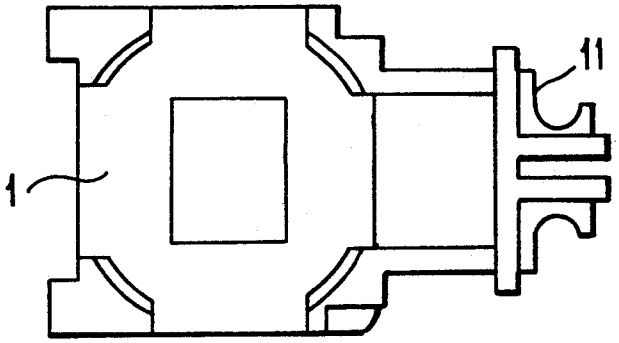
FIG. 4 is a plane view showing the position and size of the terminal base of FIG. 1 with respect to the bobbin body.
Figure 8:
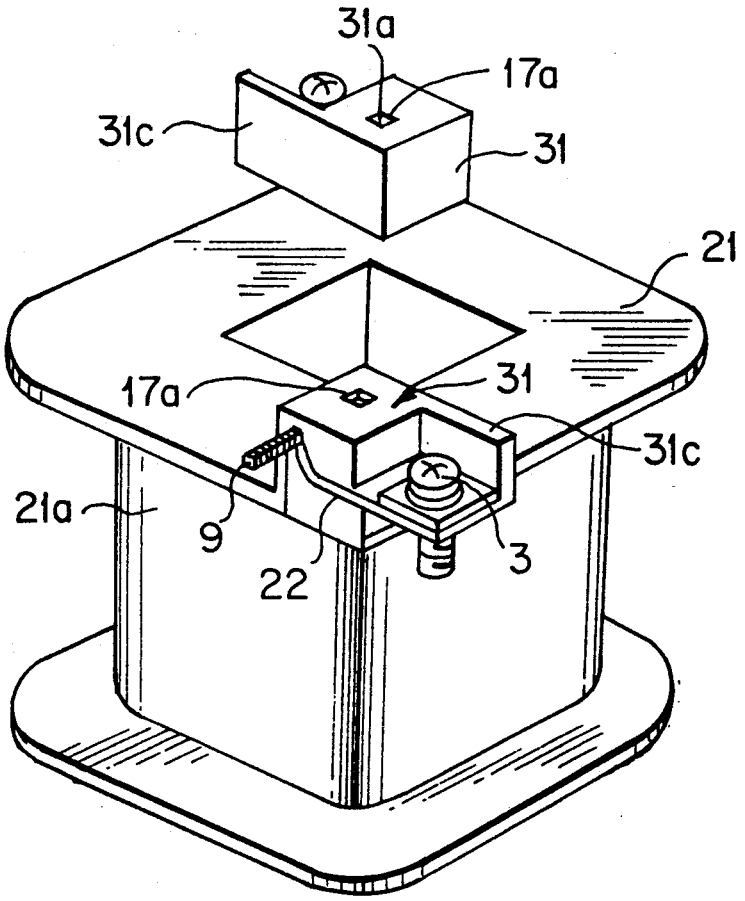
FIG. 8 PRIOR ART
FIG. 8 is a perspective view of a bobbin body incorporating the prior art terminal device.
Figure 9:
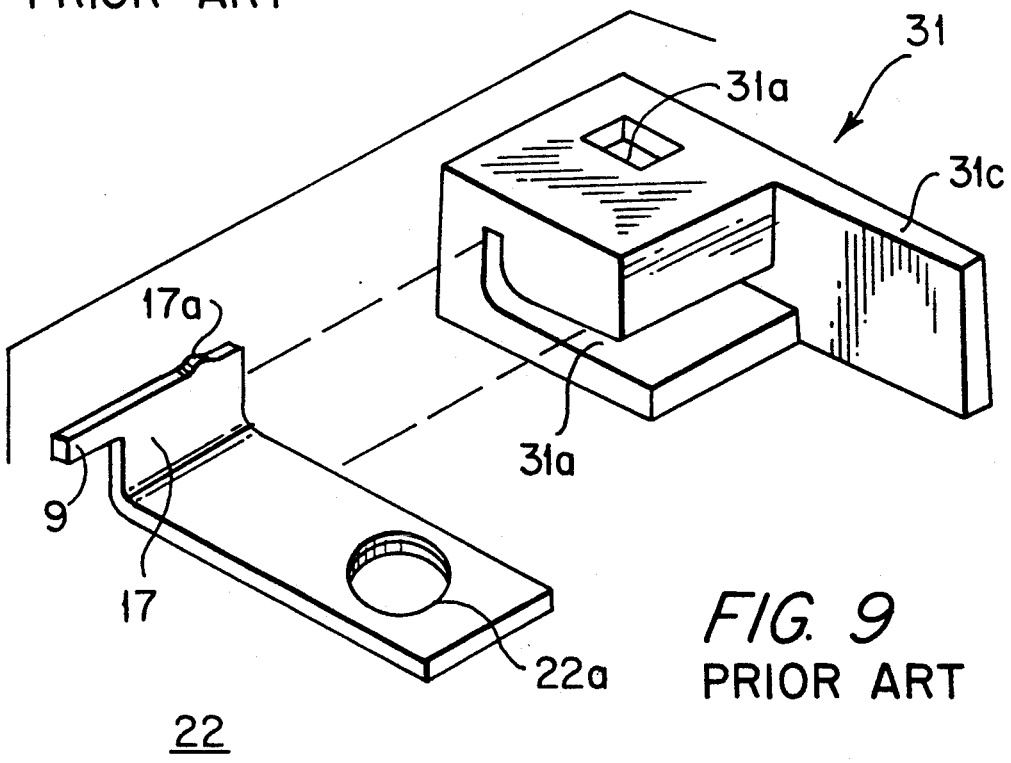
FIG. 9 PRIOR ART
FIG. 9 is an exploded perspective view of the terminal device of FIG. 8.

As shown in FIG. 1, terminal plate 2 comprises a rectangular electrically-conductive plate having a distal end portion which is bent perpendicularly to the plane of terminal plate 2 to form bent portion 7 while elongated extension portion 2*a* at a longitudinal central side portion of terminal plate 2 remains intact. Projection 7*a* is formed on an outer surface of bent portion 7, and bent portion 7 is extended in a horizontal direction to form tongue 9. A slit 5 is formed longitudinally in the proximal end portion of terminal plate 2 from the side of elongated extension portion 2*a* whereby the proximal portion is upwardly bent to form bent portion 8. Thus, the proximal end portion of terminal plate 2 forms a wide L-shaped portion. Projection 8*a* is formed on an outer surface of bent portion 8. As shown in FIG. 1, terminal base 11 to which terminal plate 2 is fixedly connected has grooves 11*a* and 11*b* into which bent portion 7 with projection 7*a* and bent portion 8 with projection 8*a* are positioned, respectively. Side wall 11*c* of terminal base 11 serves as a stopper when terminal plate 2 is positioned into grooves 11*a* and 11*b*, and has groove 11*d* into which non-bent portion 2*b* of the wide L-shaped portion of terminal plate 2 is inserted in a direction of the plane thereof. As shown in FIGS. 5 and 6, dimension H of bent portion 8 and projection 8*a* of terminal plate 2 is slightly greater than the width of grooves 11*a* and 11*b* of terminal base 11. As shown in FIGS. 2 and 3, terminal plate 2 is forced into and secured by grooves 11*a* and 11*b* of terminal base 11 thus forming the terminal device. As shown in FIGS. 2 and 3, after terminal plate 2 is fixedly connected to terminal base 11, end portion 4 of an exciting coil winding is wound around tongue 9 whereby it is connected to terminal plate 2.

Thus, bent portions 7 and 8 of terminal plate 2 are forced into grooves 11*a* and 11*b* of terminal base 11, and non-bent portion 2*b* of terminal plate 2 is inserted into groove 11*d* of terminal base 11. Therefore, terminal plate 2 is firmly secured to terminal base 11, and even if a large force acts on terminal plate 2 when an external conductor is fastened to terminal plate 2 by terminal screw 3 as shown in FIG. 2, this force is received by bent portion 8 and is negligibly transmitted to bent portion 7. Also, even if a force which is sufficiently large enough to deform bent portion 8 is applied to terminal plate 2, because of the provision of elongated extension portion 2*a* between bent portion 8 and bent portion 7, elongated extension portion 2*a* is easily deformed simultaneously with the deformation of bent portion 8. As a result, the large force is still not transmitted to bent portion 7 so that the movement of tongue 9 around which the end portion of the exciting coil winding is wound is very small, thereby eliminating the possibility that the winding may be cut.

It will be apparent to those skilled in the art that various modifications and variations can be made in the terminal plate and terminal base of the present invention and in construction of this terminal device without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A terminal device for connecting an exciting coil formed on a bobbin to an external conductor, the terminal device comprising:

a conductive terminal plate including an elongated central portion having first and second longitudinal sides and first and second ends, a first end portion formed on the first end of said central portion and perpendicular to said central portion, a plate-like second end portion, having top and bottom surfaces, formed on the second end of said central portion and coplanar with said central portion, said second portion including a portion perpendicularly extending from the top surface of said second end portion, said first end portion projecting laterally from the first longitudinal side and said second end portion projecting laterally from the second longitudinal side of said central portion a first projection protruding perpendicularly from said first end portion and a second projection protruding perpendicularly from said perpendicular portion formed on said second end portion, said first end portion having means for connecting said terminal plate to an exciting coil, and said second end portion having means for connecting said terminal plate to an external conductor; and a terminal base mountable on a bobbin, the terminal base including a first groove for housing said first projection and said first end portion, a second groove for housing said second projection and at least partially housing said second end portion, a third groove for at least partially housing a portion of said second end portion, and a fourth groove for at least partially housing said central portion of said terminal plate.

2. The terminal device of claim 1, wherein said means for connecting said terminal plate to the exciting coil comprises a tongue protruding from said first end portion of said terminal plate.

3. The terminal device of claim 1, wherein said means for connecting said terminal plate to said external conductor comprises a terminal screw secured by a screw-hole.

4. The terminal device of claim 3, wherein said screw-hole is formed in said second end portion of said terminal plate.

5. The terminal device of claim 1 wherein said terminal base further comprises a sidewall for laterally supporting said terminal plate.

* * * * *